US011794055B2

(12) United States Patent
Qiao

(10) Patent No.: US 11,794,055 B2
(45) Date of Patent: Oct. 24, 2023

(54) ELECTROMAGNETICALLY CONTROLLED WHEEL RESISTANCE ADJUSTING DEVICE

(71) Applicant: NINGBO DAOKANG INTELLIGENT TECHNOLOGY CO., LTD, Yuyao (CN)

(72) Inventor: Wei Qiao, Yuyao (CN)

(73) Assignee: NINGBO DAOKANG INTELLIGENT TECHNOLOGY CO., LTD, Yuyao (CN)

( * ) Notice: Subject to any disclaimer, the term of this patent is extended or adjusted under 35 U.S.C. 154(b) by 300 days.

(21) Appl. No.: 17/055,117

(22) PCT Filed: Sep. 4, 2020

(86) PCT No.: PCT/CN2020/113352
§ 371 (c)(1),
(2) Date: Nov. 12, 2020

(87) PCT Pub. No.: WO2022/041305
PCT Pub. Date: Mar. 3, 2022

(65) Prior Publication Data

US 2022/0314053 A1 Oct. 6, 2022

(30) Foreign Application Priority Data

Aug. 28, 2020 (CN) ..... 202021840274.9

(51) Int. Cl.
*A63B 21/005* (2006.01)

(52) U.S. Cl.
CPC ..... *A63B 21/0058* (2013.01); *A63B 21/0056* (2013.01)

(58) Field of Classification Search
CPC . A63B 21/0056; A63B 21/0058; A63B 21/00; A63B 21/005; A63B 21/012;
(Continued)

(56) References Cited

U.S. PATENT DOCUMENTS 5,094,447 A 3/1992 Wang
2011/0118086 A1* 5/2011 Radow ..... A63B 21/00196 482/5

(Continued)

FOREIGN PATENT DOCUMENTS

CN 105944287 A 9/2016
CN 207283334 U * 4/2018

(Continued)

OTHER PUBLICATIONS

English translation Huang (CN 210583475 U) (Year: 2020).*
English translation Wu (CN 109395308 A) (Year: 2019).*
English translation Su (CN 207283334 U) (Year: 2018).*

*Primary Examiner* — Loan B Jimenez
*Assistant Examiner* — Sara K. Conway
(74) *Attorney, Agent, or Firm* — Bayramoglu Law Offices LLC

(57) ABSTRACT

An electromagnetically controlled wheel resistance adjusting device includes a motor, a magnetic tile, a potentiometer, a circuit board, a socket, a connecting rod and an output gear. The socket, the motor and the potentiometer are electrically connected to the circuit board, respectively. An external controller may, through the socket and the circuit board, provide power to the motor and control operation of the motor. The external controller may, through the socket and the circuit board, provide power for the potentiometer and receive an output voltage sent by the potentiometer. The motor drives the magnetic tile to move through the output gear and the connecting rod. The output voltage of the potentiometer varies with the rotation angle of the output gear. The external controller may drive the magnetic tile to rotate through the motor, and determine the moving angle of the magnetic tile through the output voltage of the potentiometer.

9 Claims, 3 Drawing Sheets

(58) Field of Classification Search
CPC ... A63B 21/00192; A63B 21/15; A63B 21/22; A63B 21/225; A63B 21/00196; A63B 21/0051–0052; A63B 24/0087
See application file for complete search history.

(56) References Cited

U.S. PATENT DOCUMENTS

| | | | | |
|---|---|---|---|---|
| 2019/0126099 | A1* | 5/2019 | Hoang | A63F 13/335 |
| 2019/0262651 | A1* | 8/2019 | Huang | A63B 21/015 |
| 2021/0346747 | A1* | 11/2021 | Hsu | A63B 21/012 |

FOREIGN PATENT DOCUMENTS

| | | | | | |
|---|---|---|---|---|---|
| CN | 207283334 | U | | 4/2018 | |
| CN | 208229278 | U | | 12/2018 | |
| CN | 109395308 | A | * | 3/2019 | A63B 21/0058 |
| CN | 210433896 | U | | 5/2020 | |
| CN | 210583475 | U | * | 5/2020 | |
| CN | 210583475 | U | | 5/2020 | |
| CN | 211188933 | U | | 8/2020 | |

* cited by examiner

ELECTROMAGNETICALLY CONTROLLED WHEEL RESISTANCE ADJUSTING DEVICE

CROSS REFERENCE TO THE RELATED APPLICATIONS

This application is the national phase entry of International Application No. PCT/CN2020/113352, filed on Sep. 4, 2020, which is based upon and claims priority to Chinese Patent Application No. 202021840274.9, filed on Aug. 28, 2020, the entire contents of which are incorporated herein by reference.

TECHNICAL FIELD

The present invention relates to the field of fitness equipment, and in particular, to an electromagnetically controlled wheel resistance adjusting device.

BACKGROUND

In the fitness and sports equipment industry, resistance wheels typically include a device for adjusting the resistance. An example is an externally-applied magnetic-controlled resistance adjusting device. The resistance wheel is mounted with a magnetic material separated from the magnetic tile. The principle of the device is that the magnetic force between the magnetic tile and the resistance wheel provides resistance to the wheel, and the resistance can be adjusted by adjusting the distance between the magnetic tile and the wheel. For such current devices, the distance between the magnetic tile and the resistance wheel is manually adjusted by the user. This is especially cumbersome and inconvenient during use of the subject exercise equipment.

Chinese patent CN208229278U discloses a rowing device with a magnetically controlled resistance wheel structure, which includes a main frame, a pull handle, a magnetic plate assembly, a rope pulley assembly, a circular thin aluminum disk and a wheel axle. The deficiency of this technical solution lies in that the distance between the magnetic plate and the circular thin aluminum disk must be adjusted manually by the user, which is especially cumbersome and inconvenient during exercise.

SUMMARY

In view of the deficiency in the prior art, an objective of the present invention is to provide a wheel resistance adjusting device that is electromagnetically controlled.

An electromagnetically controlled wheel resistance adjusting device according to the present invention includes a motor, a magnetic tile, a potentiometer, a circuit board, a socket and an output gear.

The socket is electrically connected to the circuit board, and an external controller may be electrically connected to the circuit board through the socket to provide power for the circuit board.

The motor is electrically connected to the circuit board. The external controller may be electrically connected to the motor through the socket and the circuit board to provide power for the motor and control the motor to operate.

The potentiometer is electrically connected to the circuit board. The external controller may be electrically connected to the potentiometer through the socket and the circuit board to provide power for the potentiometer and receive an output voltage sent by the potentiometer.

The potentiometer is arranged on a rotation shaft of the output gear, and is fastened and connected to the output gear. The output voltage of the potentiometer varies with a rotation angle of the output gear.

The external controller may drive the magnetic tile to move through the motor, and determine a moving angle of the magnetic tile through the output voltage of the potentiometer.

Preferably, the electromagnetically controlled wheel resistance adjusting device further includes a mounting piece and a supporting member.

The magnetic tile is fastened and connected to the mounting piece.

The mounting piece is rotatably connected to the supporting member through a hinge.

Preferably, the electromagnetically controlled wheel resistance adjusting device further includes a connecting rod.

The output gear is movably and eccentrically connected to the connecting rod. The connecting rod is movably connected to the mounting piece through a hinge. The motor drives the mounting piece to rotate around a fixed shaft of the hinge through the output gear and the connecting rod to drive the magnetic tile to rotate.

The output gear and the connecting rod are movably connected by a hinge deviated from the rotation shaft of the output gear.

Preferably, the electromagnetically controlled wheel resistance adjusting device further includes a wire rope.

One end of the wire rope is fixedly connected to the output gear, and the other end of the wire rope is connected to the mounting piece. The motor drives the mounting piece to rotate around a fixed shaft of the hinge through the output gear and the wire rope to drive the magnetic tile to rotate.

The wire rope is wound around the output gear with a rotation of the output gear.

Preferably, the potentiometer rotates with the output gear, and the output voltage of the potentiometer and the rotation angle of the output gear have a one-to-one correspondence.

The output gear rotates to drive the magnetic tile to rotate, and the rotation angle of the output gear and the rotation angle of the magnetic tile have a one-to-one correspondence, and the output voltage of the potentiometer and the rotation angle of the magnetic tile have a one-to-one correspondence.

Preferably, the electromagnetically controlled wheel resistance adjusting device further includes a worm rod, a worm gear, a first gear, and a second gear.

The output shaft of the motor is fastened and connected to the worm rod.

The worm rod drives the worm gear, and the worm rod is movably connected to the worm gear to form a transmission pair of the worm gear and the worm rod.

The worm gear drives the first gear, and the worm gear is movably connected to the first gear to form a gear transmission pair.

The first gear drives the second gear, and the first gear is movably connected to the second gear to form a gear transmission pair.

The second gear drives the output gear, and the second gear is movably connected to the output gear to form a gear transmission pair.

The motor drives the output gear to rotate through the worm rod, the worm gear, the first gear and the second gear.

Preferably, the motor is electrically connected to the circuit board through a wire.

The potentiometer is electrically connected to the circuit board through a wire.

Preferably, the motor and the circuit board are both arranged on the supporting member, and are fastened and connected to the supporting member.

The worm gear, the first gear, the second gear and the output gear are all arranged on the supporting member, and are movably connected to the supporting member.

Preferably, the mounting piece has an arc shape, and a shape and a size of the mounting piece are matched with a shape and a size of a resistance wheel.

Compared with the prior art, the present invention has the following advantages.

1. The motor is set to drive and control the magnetic tile to rotate, so that the distance between the magnetic tile and the resistance wheel is adjusted automatically without manual adjustment by the user. This means the user does not have to stop exercising to adjust the distance between the magnetic tile and the resistance wheel during equipment use.

2. The potentiometer is set to accurately determine the rotation angle of the magnetic tile, so that the feedback control of the rotation angle of the magnetic tile is realized, which improves the accuracy of adjustment of the distance between the magnetic tile and the resistance wheel.

3. A socket is provided, so the user can plug an external controller into the socket and adjust the resistance of the resistance wheel through the external controller, which further eases overall use of the device.

BRIEF DESCRIPTION OF THE DRAWINGS

By reading the detailed description of the non-restrictive embodiments with reference to the following drawings, other features, objectives and advantages of the present invention will become more apparent.

In the figures.

Figure 1:
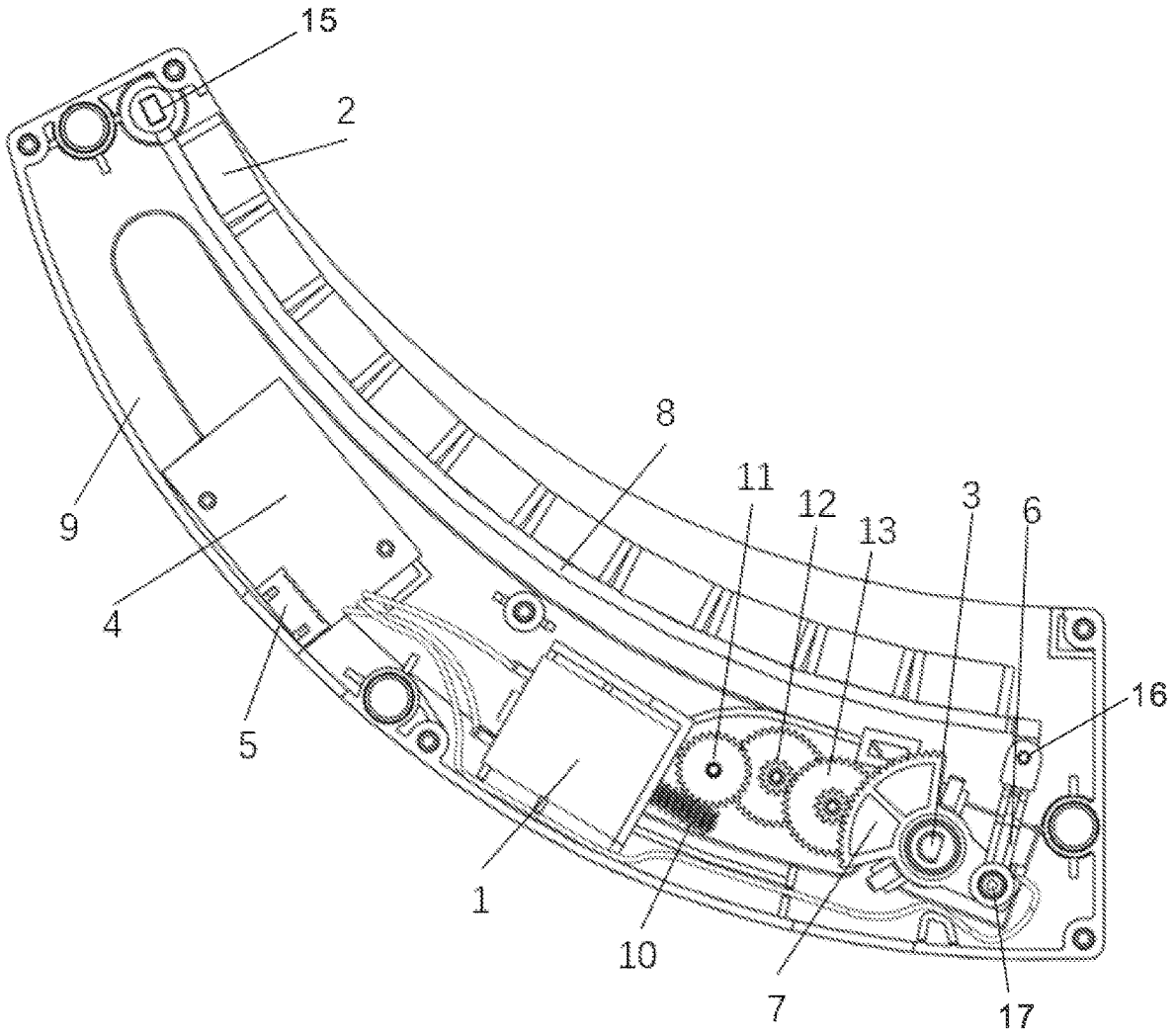
FIG. 1 is a schematic diagram showing an electromagnetically controlled wheel resistance adjusting device according to an embodiment of the present invention.

| |
|---|
| Motor 1 |
| Magnetic tile 2 |
| Potentiometer 3 |
| Circuit board 4 |
| Socket 5 |
| Connecting rod 6 |
| Output gear 7 |
| Mounting piece 8 |
| Supporting member 9 |
| Worm rod 10 |
| Worm gear 11 |
| First gear 12 |
| Second gear 13 |
| Wire rope 14 |
| First hinge 15 |
| Second hinge 16 |
| Third hinge 17 |

DETAILED DESCRIPTION OF THE EMBODIMENTS

The present invention is described in detail below in combination with specific embodiments. The following embodiments will help those skilled in the art to further understand the present invention, but do not limit the present invention in any form. It should be noted that for those having ordinary skill in the art, various changes and improvements may be made without departing from the inventive concept of the present invention, and these changes and improvements shall fall within the scope of protection of the present invention.

Embodiment 1

Figure 3:
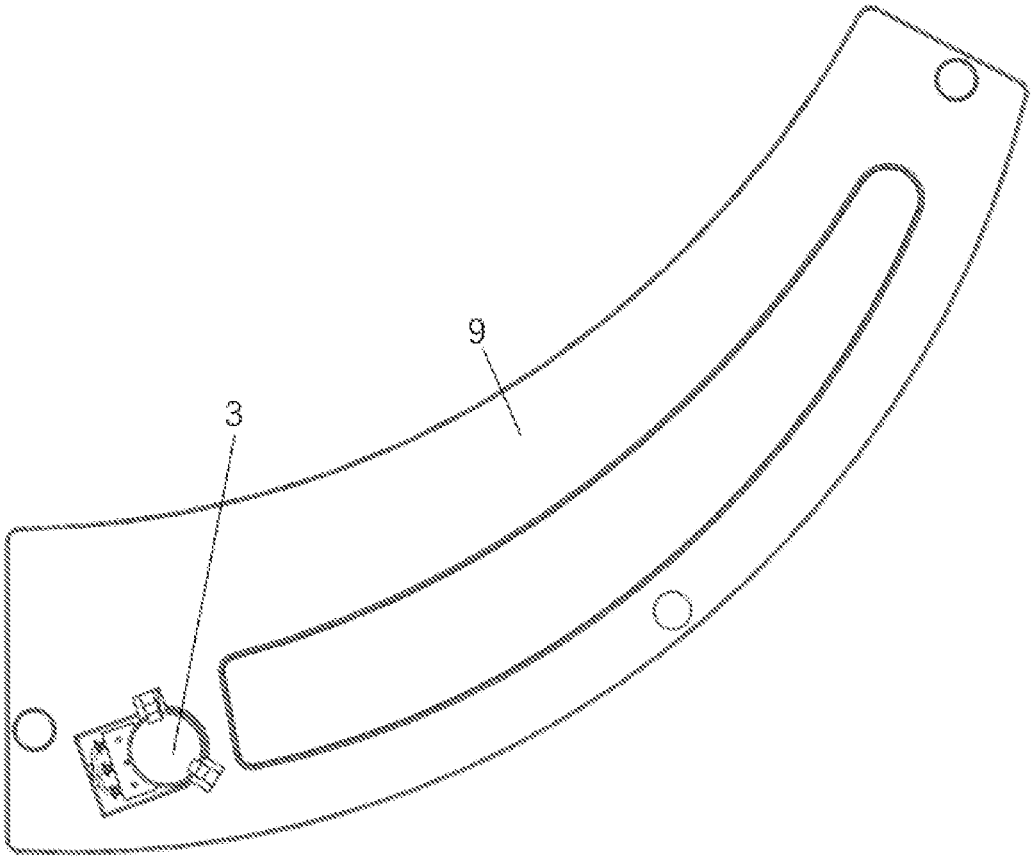
FIG. 3 is a schematic diagram showing an electromagnetically controlled wheel resistance adjusting device according to an embodiment of the present invention.

FIGS. 1 and 3 are schematic diagrams showing an electromagnetically controlled wheel resistance adjusting device according to Embodiment 1.

The electromagnetically controlled wheel resistance adjusting device according to the present embodiment includes the motor 1, the magnetic tile 2, the potentiometer 3, the circuit board 4, the socket 5, the connecting rod 6, the output gear 7, the mounting piece 8, the supporting member 9, the worm rod 10, the worm gear 11, the first gear 12, and the second gear 13.

The circuit board 4 is arranged on the supporting member 9, and is fastened and connected to the supporting member 9. The socket 5 is welded on the circuit board 4, and is electrically connected to the circuit board 4. An external controller may be electrically connected to the circuit board 4 through the socket 5 to provide power for the circuit board 4.

The motor 1 is arranged on the supporting member 9, and is fastened and connected to the supporting member 9. The motor 1 is electrically connected to the circuit board 4 through a wire. The external controller may be electrically connected to the motor 1 through the socket 5 and the circuit board 4 to provide power for the motor 1 and control the motor 1 to operate.

The potentiometer 3 is arranged on the rotation shaft of the output gear 7 and is coaxially fastened and connected to the output gear 7. The output voltage of the potentiometer 3 varies with the rotation angle of the output gear 7. The potentiometer 3 is further electrically connected to the circuit board 4 through a wire. The external controller may be electrically connected to the potentiometer 3 through the socket 5 and the circuit board 4 to provide power for the potentiometer 3 and receive the output voltage sent by the potentiometer 3.

The output gear 7 is arranged on the supporting member 9, and is movably connected to the supporting member 9. The output gear 7 is further movably and eccentrically connected to the connecting rod 6. The output gear 7 and the connecting rod 6 are movably connected by a third hinge 17 deviated from the rotation shaft of the output gear 7. The motor 1 drives the magnetic tile 2 to rotate through the output gear 7 and the connecting rod 6.

The mounting piece 8 has an arc shape, and the shape and size of the mounting piece 8 are matched with the shape and size of the resistance wheel. The magnetic tile 2 is fastened and connected to the mounting piece 8. The mounting piece 8 is rotatably connected to the supporting member 9 through a first hinge 15, and the connecting rod 6 is movably connected to the mounting piece 8 through a second hinge 16. The connecting rod 6 drives the magnetic tile 2 to rotate by driving the mounting piece 8 to rotate around the fixed shaft of the first hinge 15.

The potentiometer 3 rotates with the output gear 7, and the output voltage of the potentiometer 3 and the rotation angle of the output gear 7 have a one-to-one correspondence. The output gear 7 rotates to drive the magnetic tile 2 to rotate, and the rotation angle of the output gear 7 and the rotation angle of the magnetic tile 2 have a one-to-one correspondence, so that the output voltage of the potentiometer 3 and the rotation angle of the magnetic tile 2 have a one-to-one correspondence.

The motor 1 drives the output gear 7 to rotate through the worm rod 10, the worm gear 11, the first gear 12 and the second gear 13. The output shaft of the motor 1 is fastened and connected to the worm rod 10. The worm rod 10 drives the worm gear 11, and the worm rod 10 is movably connected to the worm gear 11 to form a transmission pair of the worm gear 11 and the worm rod 10. The worm gear 11 drives the first gear 12, and the worm gear 11 is movably connected to the first gear 12 to form a gear transmission pair. The first gear 12 drives the second gear 13, and the first gear 12 is movably connected to the second gear 13 to form a gear transmission pair. The second gear 13 drives the output gear 7, and the second gear 13 is movably connected to the output gear 7 to form a gear transmission pair.

The worm gear 11, the first gear 12 and the second gear 13 are all arranged on the supporting member 9, rotate on the supporting member 9, and are movably connected to the supporting member 9.

The external controller may apply a voltage to the motor 1 through the socket 5, the circuit board 4 and a wire, and control the motor 1 to rotate. The motor 1 can rotate clockwise or counterclockwise. The rotation direction of the motor 1 depends on the direction of the applied voltage. The worm rod 10 fastened and connected to the output shaft of the motor 1 rotates. The worm rod 10 drives the worm gear 11 to rotate, the worm gear 11 drives the first gear 12 to rotate, and the first gear 12 drives the second gear 13 to rotate, and the second gear 13 drives the output gear 7 to rotate. On the one hand, the output gear 7 rotates to drive the connecting rod 6 to move, the connecting rod 6 drives the mounting piece 8 to rotate around the fixed shaft of the hinge, and the mounting piece 8 drives the magnetic tile 2 fastened and connected to the mounting piece 8 to rotate. On the other hand, the potentiometer 3 rotates at an equal angle with the output gear 7, and the potentiometer 3 feeds back the output voltage to the circuit board 4 through a wire. Based on the one-to-one correspondence between the output voltage of the potentiometer 3 and the rotation angle of the magnetic tile 2, the external controller can accurately determine the rotation angle of the magnetic tile 2 according to the output voltage. When the resistance value of the resistance wheel deviates from a set value, the external controller can control the motor 1 to drive the magnetic tile 2 to rotate according to the output voltage fed back by the potentiometer 3, to enable the resistance value of the resistance wheel to return to the set value, thereby automatically controlling the rotation of the magnetic tile 2.

Embodiment 2

Figure 2:
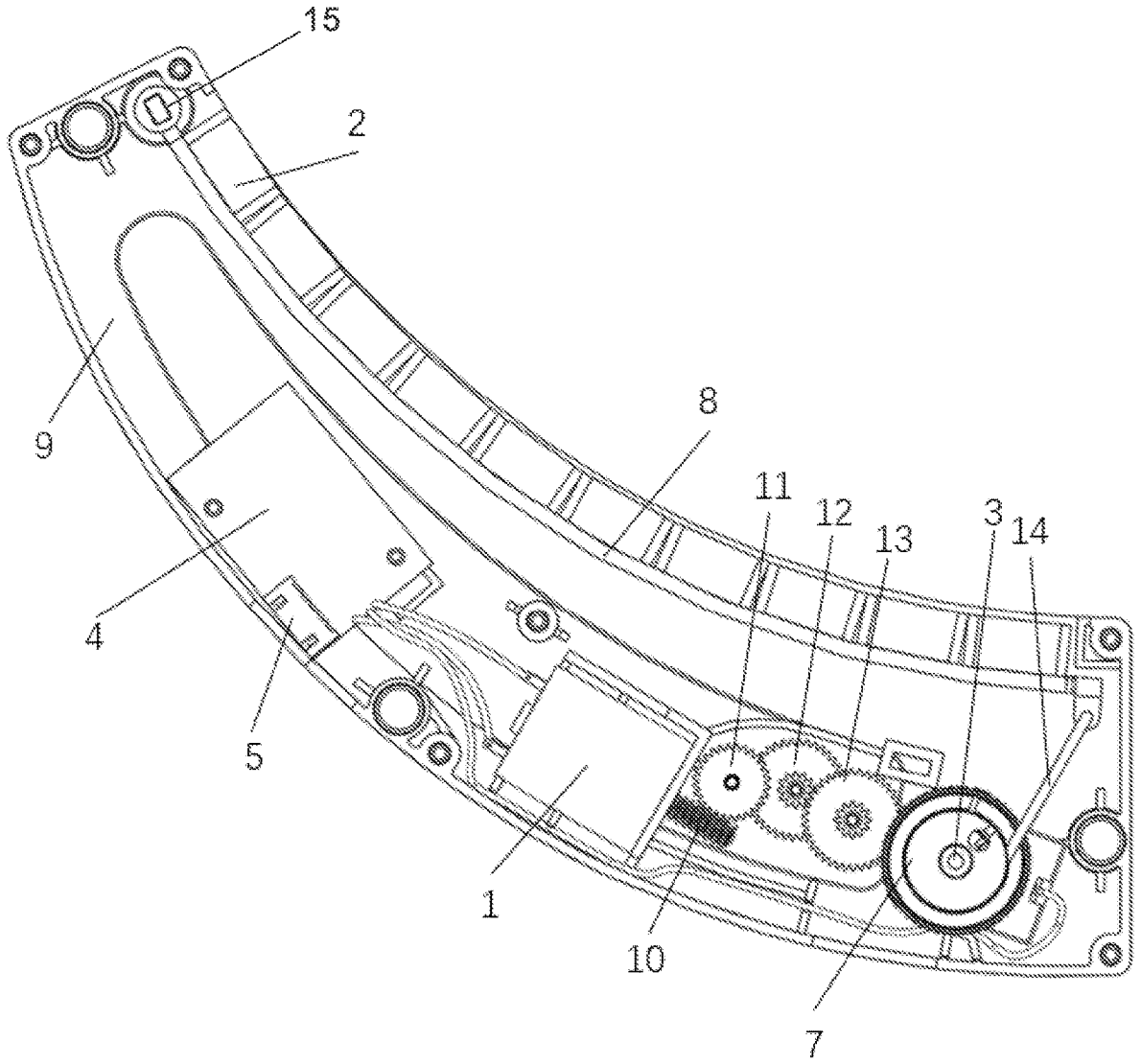
FIG. 2 is a schematic diagram showing an electromagnetically controlled wheel resistance adjusting device according to an embodiment of the present invention.

FIG. 2 is a schematic diagram showing an electromagnetically controlled wheel resistance adjusting device according to Embodiment 2.

Embodiment 2 is a variation of Embodiment 1. The variation is that the wire rope 14 is provided in Embodiment 2. One end of the wire rope 14 is fixedly connected to the output gear 7, and the other end of the wire rope 14 is connected to the mounting piece 8. The wire rope 14 is wound around the output gear 7 with the rotation of the output gear 7. The motor 1 drives the mounting piece 8 to rotate around the fixed shaft of the hinge through the output gear 7 and the wire rope 14, so as to drive the magnetic tile 2 to rotate.

In the description of the present invention, the terms "upper/above", "lower/under", "front", "rear", "left", "right", "vertical", "horizontal", "top", "bottom", "inner/inside/interior", "outer/outside/exterior", and the like indicating the directional or positional relationships, are based on the directional or positional relationships shown in the drawings, and are merely used to facilitate description, rather than indicating or implying that the device or element must have a specific orientation, be configured and operated in a specific orientation, and therefore cannot be construed as a limitation to the present invention.

The embodiments of the present invention are described above. It should be understood that the present invention is not limited to the above embodiments, and those skilled in the art can make various changes or modifications within the scope of the claim, which does not affect the substantive content of the present invention. As long as there is no conflict, embodiments of the present invention as well as the features in the embodiments can be arbitrarily combined with each other.

What is claimed is:

1. An electromagnetically controlled wheel resistance adjusting device, comprising a motor, a magnetic tile, a potentiometer, a circuit board, a socket, an output gear, a mounting piece and a supporting member; wherein, the socket is electrically connected to the circuit board, and an external controller is electrically connected to the circuit board through the socket to provide a power for the circuit board;

the motor is electrically connected to the circuit board; the external controller is electrically connected to the motor through the socket and the circuit board to provide the power for the motor and control the motor to operate;

the potentiometer is electrically connected to the circuit board; the external controller is electrically connected to the potentiometer through the socket and the circuit board to provide the power for the potentiometer and receive an output voltage sent by the potentiometer;

the potentiometer is arranged on a rotation shaft of the output gear, and the potentiometer is fastened and connected to the output gear; the output voltage of the potentiometer varies with a rotation angle of the output gear; and the external controller drives the magnetic tile to rotate through the motor, and the external controller determines a rotation angle of the magnetic tile through the output voltage of the potentiometer;

the magnetic tile is fastened and connected to the mounting piece;

the mounting piece is rotatably connected to the supporting member through a first hinge; and at least one of the motor, the circuit board, a worm gear, a first gear, a second gear or the output gear is arranged on the supporting member.

2. The electromagnetically controlled wheel resistance adjusting device according to claim 1, further comprising a wire rope; wherein, a first end of the wire rope is fixedly connected to the output gear, and a second end of the wire rope is connected to the mounting piece; the motor drives the mounting piece to rotate around a fixed shaft of the first hinge through the output gear and the wire rope to drive the magnetic tile to rotate; and the wire rope is wound around the output gear with a rotation of the output gear.

3. The electromagnetically controlled wheel resistance adjusting device according to claim 1, wherein, the potentiometer rotates with the output gear, and the output voltage of the potentiometer and the rotation angle of the output gear have a one-to-one correspondence; and the output gear rotates to drive the magnetic tile to rotate, and the rotation angle of the output gear and the rotation angle of the magnetic tile have a one-to-one correspondence, and the output voltage of the potentiometer and the rotation angle of the magnetic tile have a one-to-one correspondence.

4. The electromagnetically controlled wheel resistance adjusting device according to claim 1, further comprising a worm rod, the worm gear, the first gear, and the second gear; wherein an output shaft of the motor is fastened and connected to the worm rod;

the worm rod drives the worm gear, and the worm rod is movably connected to the worm gear to form a transmission pair of the worm gear and the worm rod;

the worm gear drives the first gear, and the worm gear is movably connected to the first gear to form a first gear transmission pair;

the first gear drives the second gear, and the first gear is movably connected to the second gear to form a second gear transmission pair;

the second gear drives the output gear, and the second gear is movably connected to the output gear to form a third gear transmission pair; and the motor drives the output gear to rotate through the worm rod, the worm gear, the first gear and the second gear.

5. The electromagnetically controlled wheel resistance adjusting device according to claim 4, wherein, the motor and the circuit board are arranged on a supporting member, and the motor and the circuit board are fastened and connected to the supporting member;

the worm gear, the first gear, the second gear and the output gear are arranged on the supporting member, and the worm gear, the first gear, the second gear and the output gear are movably connected to the supporting member.

6. The electromagnetically controlled wheel resistance adjusting device according to claim 1, wherein, the motor is electrically connected to the circuit board through a first wire; and the potentiometer is electrically connected to the circuit board through a second wire.

7. The electromagnetically controlled wheel resistance adjusting device according to claim 1, wherein, the motor and the circuit board are arranged on the supporting member, and the motor and the circuit board are fastened and connected to the supporting member;

the worm gear, the first gear, the second gear and the output gear are arranged on the supporting member, and the worm gear, the first gear, the second gear and the output gear are movably connected to the supporting member.

8. The electromagnetically controlled wheel resistance adjusting device according to claim 1, wherein, the mounting piece has an arc shape, and a shape and a size of the mounting piece are matched with a shape and a size of a resistance wheel.

9. An electromagnetically controlled wheel resistance adjusting device, comprising a motor, a magnetic tile, a potentiometer, a circuit board, a socket, a mounting piece, a supporting member, a connecting rod and an output gear; wherein, the magnetic tile is fastened and connected to the mounting piece;

the mounting piece is rotatably connected to the supporting member through a first hinge;

the socket is electrically connected to the circuit board, and an external controller is electrically connected to the circuit board through the socket to provide a power for the circuit board;

the motor is electrically connected to the circuit board; the external controller is electrically connected to the motor through the socket and the circuit board to provide the power for the motor and control the motor to operate;

the potentiometer is electrically connected to the circuit board; the external controller is electrically connected to the potentiometer through the socket and the circuit board to provide the power for the potentiometer and receive an output voltage sent by the potentiometer;

the potentiometer is arranged on a rotation shaft of the output gear, and the potentiometer is fastened and connected to the output gear; the output voltage of the potentiometer varies with a rotation angle of the output gear;

the external controller drives the magnetic tile to rotate through the motor, and the external controller determines a rotation angle of the magnetic tile through the output voltage of the potentiometer;

the output gear is movably and eccentrically connected to the connecting rod; the connecting rod is movably connected to the mounting piece through a second hinge; the motor drives the mounting piece to rotate around a fixed shaft of the first hinge through the output gear and the connecting rod to drive the magnetic tile to rotate; and the output gear and the connecting rod are movably connected by a third hinge, and the third hinge is deviated from the rotation shaft of the output gear.

* * * * *